US010871046B2

(12) United States Patent
McInally et al.

(10) Patent No.: US 10,871,046 B2
(45) Date of Patent: Dec. 22, 2020

(54) DOWHOLE TRACTOR COMPRISING A HYDRAULIC SUPPLY LINE FOR ACTUATING HYDRAULIC COMPONENTS

(71) Applicant: Altus Intervention (Technologies) AS, Stavanger (NO)

(72) Inventors: Gerald McInally, Bryne (NO); Mauro Antonio Zambrana Puerta, Houston, TX (US)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 15/999,340

(22) PCT Filed: Jan. 18, 2017

(86) PCT No.: PCT/NO2017/050017
§ 371 (c)(1),
(2) Date: Aug. 17, 2018

(87) PCT Pub. No.: WO2017/142415
PCT Pub. Date: Aug. 24, 2017

(65) Prior Publication Data

US 2019/0040700 A1 Feb. 7, 2019

(30) Foreign Application Priority Data

Feb. 17, 2016 (NO) ..... 20160278

(51) Int. Cl.
*E21B 23/14* (2006.01)
*E21B 4/18* (2006.01)
(Continued)

(52) U.S. Cl.
CPC ..... *E21B 23/14* (2013.01); *E21B 4/18* (2013.01); *E21B 23/04* (2013.01); *E21B 7/06* (2013.01); *E21B 23/001* (2020.05)

(58) Field of Classification Search
CPC . E21B 23/14; E21B 4/18; E21B 23/04; E21B 2023/008; E21B 7/06
See application file for complete search history.

(56) References Cited

U.S. PATENT DOCUMENTS

2002/0029908 A1 3/2002 Bloom et al.
2004/0040707 A1 3/2004 Dusterhoft et al.
(Continued)

FOREIGN PATENT DOCUMENTS

EP 0110182 A2 11/1983
EP 2505772 B1 5/2013
WO 0046471 A3 8/2000

*Primary Examiner* — D. Andrews
*Assistant Examiner* — Manuel C Portocarrero
(74) *Attorney, Agent, or Firm* — Gable Gotwals

(57) ABSTRACT

The downhole tractor further comprises a hydraulic power pack coupled to the hydraulic supply line, at least one hydraulic component and at least one further hydraulic component. The hydraulic components are coupled to the hydraulic supply line in parallel and configured for being actuated by the hydraulic supply line. The hydraulic supply line comprises a controllable valve placed at a location in between the at least one hydraulic component and the at least one further hydraulic component such that a first part of the hydraulic supply line is coupled to a second part of the hydraulic supply line via the controllable valve. The downhole tractor provides for much better control and facilitates tuning of the performance of the tractor to the actual needs.

8 Claims, 4 Drawing Sheets

Figure 1:
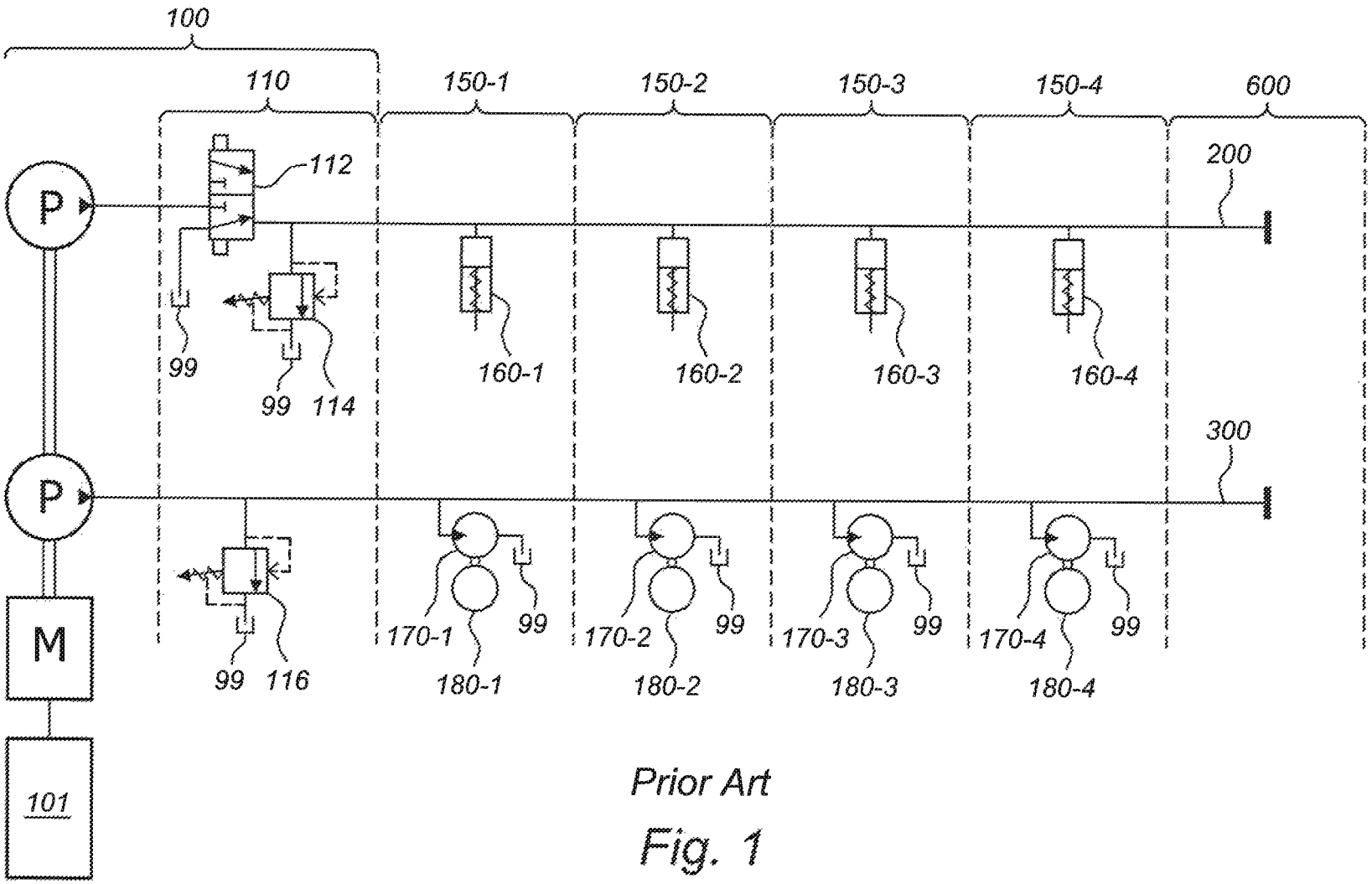
Prior Art Fig. 1

(51) Int. Cl.

| | |
|---|---|
| ***E21B 23/04*** | (2006.01) |
| ***E21B 23/00*** | (2006.01) |
| ***E21B 7/06*** | (2006.01) |

(56) References Cited

U.S. PATENT DOCUMENTS

| | | | | |
|---|---|---|---|---|
| 2010/0307832 | A1 | 12/2010 | Mock et al. | |
| 2011/0036632 | A1 | 2/2011 | Polynstev | |
| 2015/0167416 | A1* | 6/2015 | Ludwig | E21B 4/18 166/385 |

* cited by examiner

DOWHOLE TRACTOR COMPRISING A HYDRAULIC SUPPLY LINE FOR ACTUATING HYDRAULIC COMPONENTS

CROSS-REFERENCE TO RELATED APPLICATIONS

This United States application is the National Phase of PCT Application No. PCT/NO2017/050017 filed 18 Jan. 2017, which claims priority to Norwegian Patent Application No. 20160278 filed 17 Feb. 2016, each of which is incorporated herein by reference.

BACKGROUND OF THE INVENTION

FIELD OF THE INVENTION

The invention relates to a downhole tractor comprising a hydraulic supply line for actuating hydraulic components. The downhole tractor further comprises a hydraulic power pack coupled to the hydraulic supply line, a first hydraulic component and a second hydraulic component. The hydraulic components are coupled to the hydraulic supply line in parallel and configured for being actuated by the hydraulic supply line.

BACKGROUND OF THE INVENTION

Downhole tractors are typically used in the oil industry to gain access and perform operations inside oil wells. Downhole tractors are used as a conveyance platform to transport other well logging or well intervention equipment into the otherwise inaccessible highly deviated or horizontal sections of oil wells. In addition, downhole tractors can be used as a conveyance platform for milling and rotational equipment—not only in highly deviated and horizontal sections of oil wells, but also in more vertical sections. Milling and rotational equipment needs to be held in position, both in the axis of the well bore but also in against counter rotation torque generated by the milling bit rotation. Also especially for milling, the amount of force applied in an axial direction to the milling bit needs to be carefully controlled to provide the most effective milling action. The downhole tractor can provide both of these anchoring and weight on bit functions, in addition to acting as a general conveyance platform as described earlier.

There are a number of challenges in the operation of current downhole tractor technology, which are critical for the success or performance of a tractor conveyed operation.

- The speed at which the tractor can convey its payload in and out of the oil well is a key performance factor, i.e. the faster the job can be completed safely, the less valuable rig time is used and the faster the oil well can be put back into operation, which means less cost overhead for the oil well operator.
- In an oil well construction there can be many different completion elements such as transitions in tubing size, gauge hangers, sliding sleeves, etc. These elements may obstruct the tractor from progressing past such obstacle. This may limit the scope of use of tractors in some oil wells.
- For challenging tractor conveyed milling operations, total operator control of all milling parameters, including the axial force applied to the bit and optimizing the available torque of the milling motor, are very important for the success of the operation, but current tractor technology has limitations in the amount of control available.

A typical downhole tractor with hydraulic drive consists of the following elements: normally connected together in the following order: a control section with controls switching on and off the tractor function (either electronically or by mechanical means), a downhole motor (electrically powered or fluid driven turbine), a hydraulic pump with one or more outlets, a manifold block which controls the hydraulic functions, such as maximum pump pressure and the sequential deployment of the pump outputs. These elements constitute a hydraulic 'power pack' whose output consists of one or more controlled hydraulic supply lines and a hydraulic fluid return line.

Normally the tractor drive sections are modules, which can be added in parallel to the hydraulic supply lines provided by the power pack, so that sections can be added or removed as required. Due to the modular nature of the construction, drive sections can be added to provide more pulling force as needed, but although this does give more driving force for the same pump output pressure, it also means that more motors are consuming the available pump flow so that the available flow per motor reduces and thereby the conveyance speed of the tractor reduces.

With this type of construction in the current art, the tractor is built up from a certain number of modules based on the predicted job maximum requirements, but there is very little or no control of the configuration once the tractor is deployed in the well.

As is obviated in the discussion above the current prior art there is a need for further improving downhole tractor technology.

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect, the invention relates to a downhole tractor comprising a hydraulic supply line for actuating hydraulic components. The downhole tractor further comprises a hydraulic power pack coupled to the hydraulic supply line, at least one hydraulic component and at least one further hydraulic component, wherein the said hydraulic components are coupled to the hydraulic supply line in parallel and configured for being actuated by the hydraulic supply line. The hydraulic supply line comprises a controllable valve placed at a location in between the at least one hydraulic component and the at least one further hydraulic component such that a first part of the hydraulic supply line is coupled to a second part of the hydraulic supply line via the controllable valve.

The effects of the downhole tractor in accordance with the invention may be understood as follows. The downhole tractors of the prior art use their hydraulic power pack to drive the hydraulic supply line (or lines). In the known downhole tractors this hydraulic supply line is subsequently used for delivering hydraulic fluid to the individual hydraulic components (i.e. hydraulic motors for the tractor wheels, hydraulic cylinders for the tractor arms, and even further pressure regulating valves in some embodiments of this invention), which are coupled to the hydraulic supply line in parallel (in case of a unidirectional hydraulic supply line the individual hydraulic components feed their hydraulic fluid back to the hydraulic tank via a return line). All hydraulic components receive hydraulic fluid at substantially the same pressure. There is no control on the individual components. The addition of the controllable valve in the hydraulic supply line as envisaged in the invention, makes it possible to couple the second part to the first part in a first operational mode (rendering all hydraulic components active) and for decoupling the second part from the first part in a second operational mode (rendering the at least one further hydraulic components deactivated).

Referring to the tractor performance requirements as previously described, the invention makes it possible to control downhole tractor performance in an advantageous manner which is currently not possible. For instance, when the hydraulic components are hydraulic motors each driving a tractor wheel, then the tractor may switch between, for instance, 2-wheel drive at high conveyance speed with low pulling force, and, for instance, all-wheel (4-wheel) drive at low conveyance speed with high pulling force.

A few terms used in this specification will be explained hereinafter.

Wherever the wording "hydraulic supply line" is used, this refers to either a unidirectional hydraulic supply line or a bidirectional hydraulic supply line. In case of a unidirectional hydraulic supply line, there is also a return line connected to connected hydraulic components for delivering the hydraulic fluid back to the hydraulic tank. In case of a bidirectional hydraulic supply line, the hydraulic fluid is delivered back to the hydraulic tank through the hydraulic supply line itself (typically, a sequence valve in the hydraulic power pack needs to be switched to its other mode for reversing the hydraulic fluid flow). It is also important to note that the hydraulic supply line may be a main hydraulic supply line or a branch thereof, which supplies hydraulic fluid to further hydraulic components (hydraulic cylinders, hydraulic motors, relief valves, etc.). The principle of the invention still applies in such cases.

An embodiment of the downhole tractor in accordance with the invention further comprises a valve control unit coupled to the controllable valve for controlling opening and closing of the controllable valve to switch between said operational modes. This embodiment conveniently provides for a downhole tractor capable of dynamically switching between its operational modes. Such operational mode switching may be carried out done under control of the tractor operator, or it may be triggered by the tractor itself based upon sensor inputs and the like. In an embodiment, the valve control unit may be integrated as an extra function into the existing control units of the tractor.

An embodiment of the downhole tractor in accordance with the invention further comprises a further controllable valve in at least one of said parts of the hydraulic supply line for dividing said part into a respective subparts, wherein each subpart is configured for driving at least one hydraulic component. This embodiment illustrates that the principle of the invention can be repeated in that the hydraulic supply line can be divided into more than two (sub-)parts separated by a controllable valve, wherein each (sub-)part drives at least one hydraulic component. In the earlier given example of a four-wheeled tractor, this implies that this embodiment of the invention enables to use one, two, three or four wheels for driving the tractor. Expressed differently, this embodiment of the invention enables the use of more than two operational modes per hydraulic supply line. In case of embodiments having more than one hydraulic supply line having controllable valves, this implies even more permutations, i.e. operational modes.

An embodiment of the downhole tractor in accordance with the invention further comprises a further valve control unit coupled to the further controllable valve. Similar to the earlier-mentioned embodiment this embodiment conveniently provides for a downhole tractor capable of dynamically switching between its operational modes. Such operational mode switching may carried out done under control of the tractor operator, or it may be triggered by the tractor itself based upon sensor inputs and the like. In an embodiment, further valve control unit may be integrated into another control unit of the tractor.

In an embodiment of the downhole tractor in accordance with the invention the hydraulic supply line comprises a unidirectional hydraulic supply line. The controllable valve in accordance with the invention may be conveniently placed in a unidirectional hydraulic supply line.

In an embodiment of the downhole tractor in accordance with the invention the at least one hydraulic component comprises a plurality of hydraulic motors each configured for driving a respective tractor wheel. In this embodiment the number of tractor wheels is increased, i.e. more tractor wheels are driven by the first part of the hydraulic line. In this embodiment, the different operational modes of the downhole tractor relate to the number of tractor wheels that are driven to convey the tractor.

In an embodiment of the downhole tractor in accordance with the invention the at least one further hydraulic component comprises a further plurality of hydraulic motors each configured for driving a respective tractor wheel. In this embodiment the number of tractor wheels is further increased, i.e. more tractor wheels are driven by the second part of the hydraulic line. Also in this embodiment, the different operational modes of the downhole tractor relate to the number of tractor wheels that are driven to convey the tractor.

In an embodiment of the downhole tractor in accordance with the invention the hydraulic supply line comprises a bidirectional hydraulic supply line. The controllable valve in accordance with the invention may be conveniently placed in a bidirectional hydraulic supply line.

In an embodiment of the downhole tractor in accordance with the invention the at least one hydraulic component comprises a plurality of hydraulic cylinders each configured for driving a respective tractor arm. In this embodiment the number of tractor arms is increased, i.e. more tractor arms are driven by the first part of the hydraulic line. In this embodiment, the different operational modes of the downhole tractor relate to the number of tractor arms that are activated to convey the tractor.

In an embodiment of the downhole tractor in accordance with the invention the at least one further hydraulic component comprises a further plurality of hydraulic cylinders each configured for driving a respective tractor arm. In this embodiment the number of tractor arms is further increased, i.e. more tractor arms are driven by the second part of the hydraulic line. Also in this embodiment, the different operational modes of the downhole tractor relate to the number of tractor arms that are activated to convey the tractor.

An embodiment of the downhole tractor in accordance with the invention further comprising a further hydraulic supply line. Some downhole tractors have only one hydraulic supply line and others have two or more. The invention may be conveniently applied in each of the hydraulic supply lines. Such hydraulic supply lines may be either a unidirectional or bidirectional as already discussed in view of the other embodiments. The same embodiments and variants apply to this second or further hydraulic supply line, and therefore these embodiments will not be discussed in detail.

In an embodiment of the downhole tractor in accordance with the invention the at least one hydraulic component and/or the at least one further hydraulic component comprises a relief valve. Even though the hydraulic power pack may already comprise one or more controllable relief valves, this embodiment provides for additional advantage by providing such relief valve for one or more of said parts of the hydraulic supply line. This means that the hydraulic pressure can locally be reduced, for instance for reducing the pulling or pushing force of the downhole tractor. Expressed differently, the pulling force may be adapted, not by varying the number of wheels that are driven, but by reducing the force applied by at least one of the driven wheels.

BRIEF INTRODUCTION OF THE DRAWINGS

Figure 2:
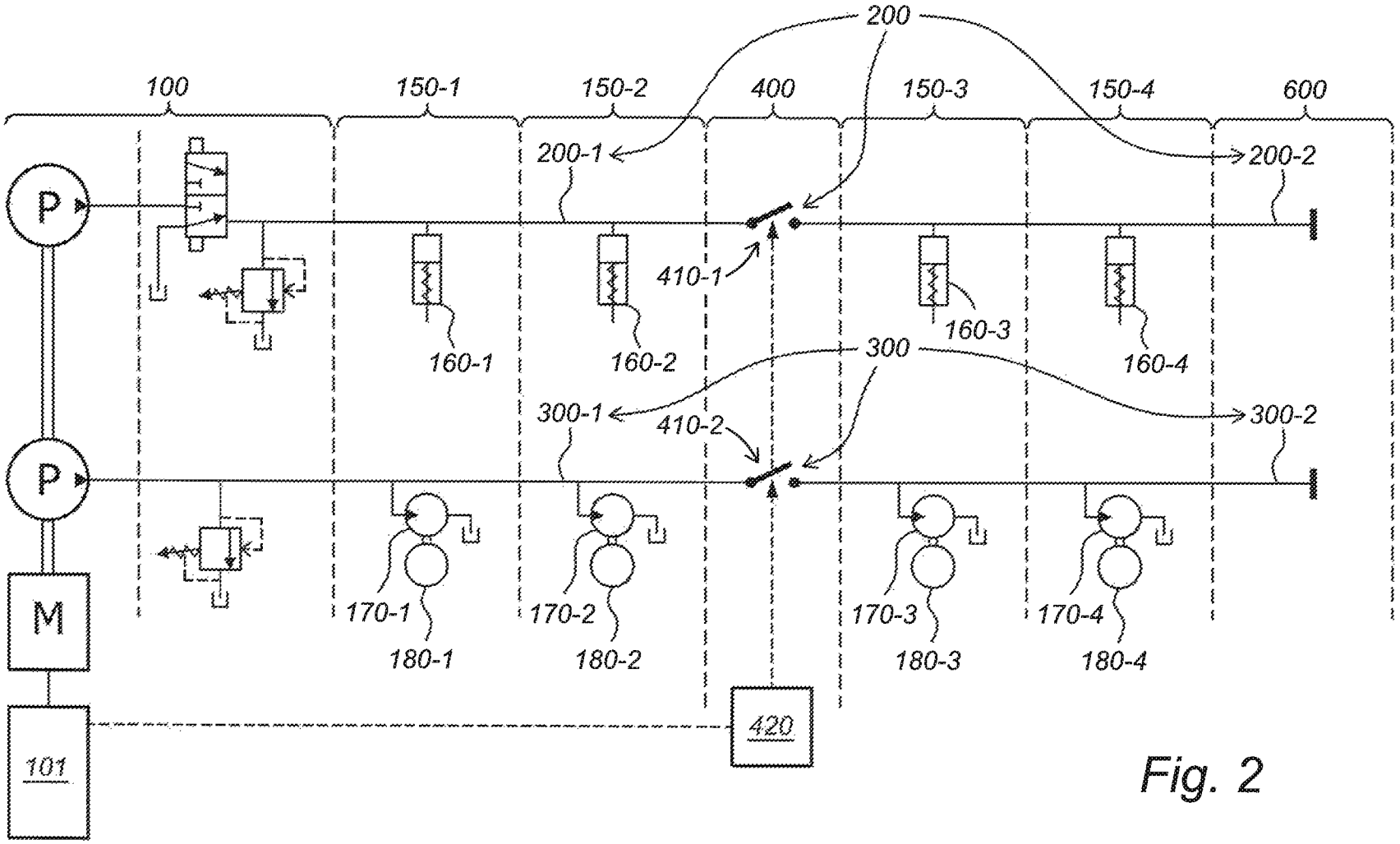
Figure 3:
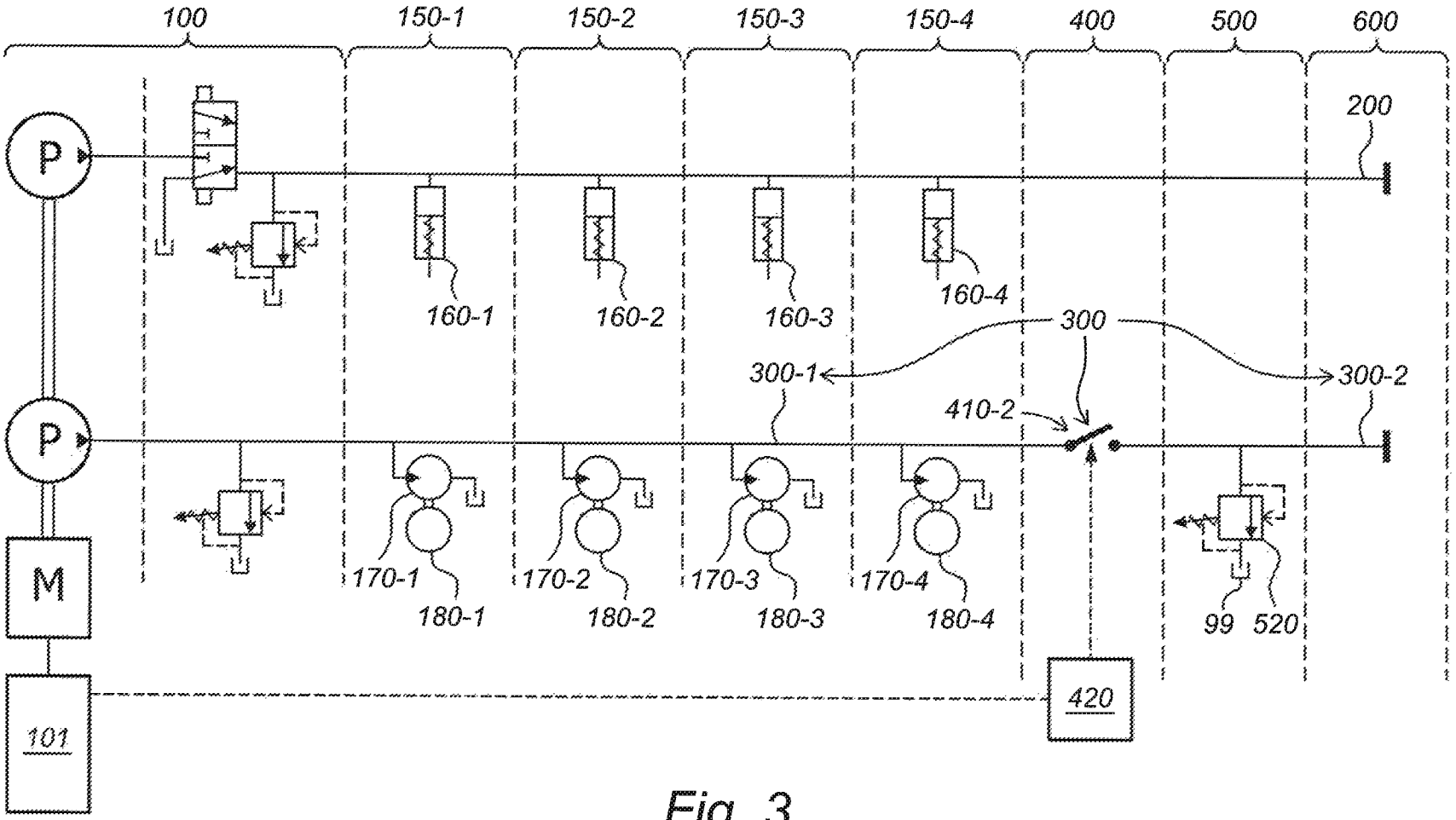
Figure 4:
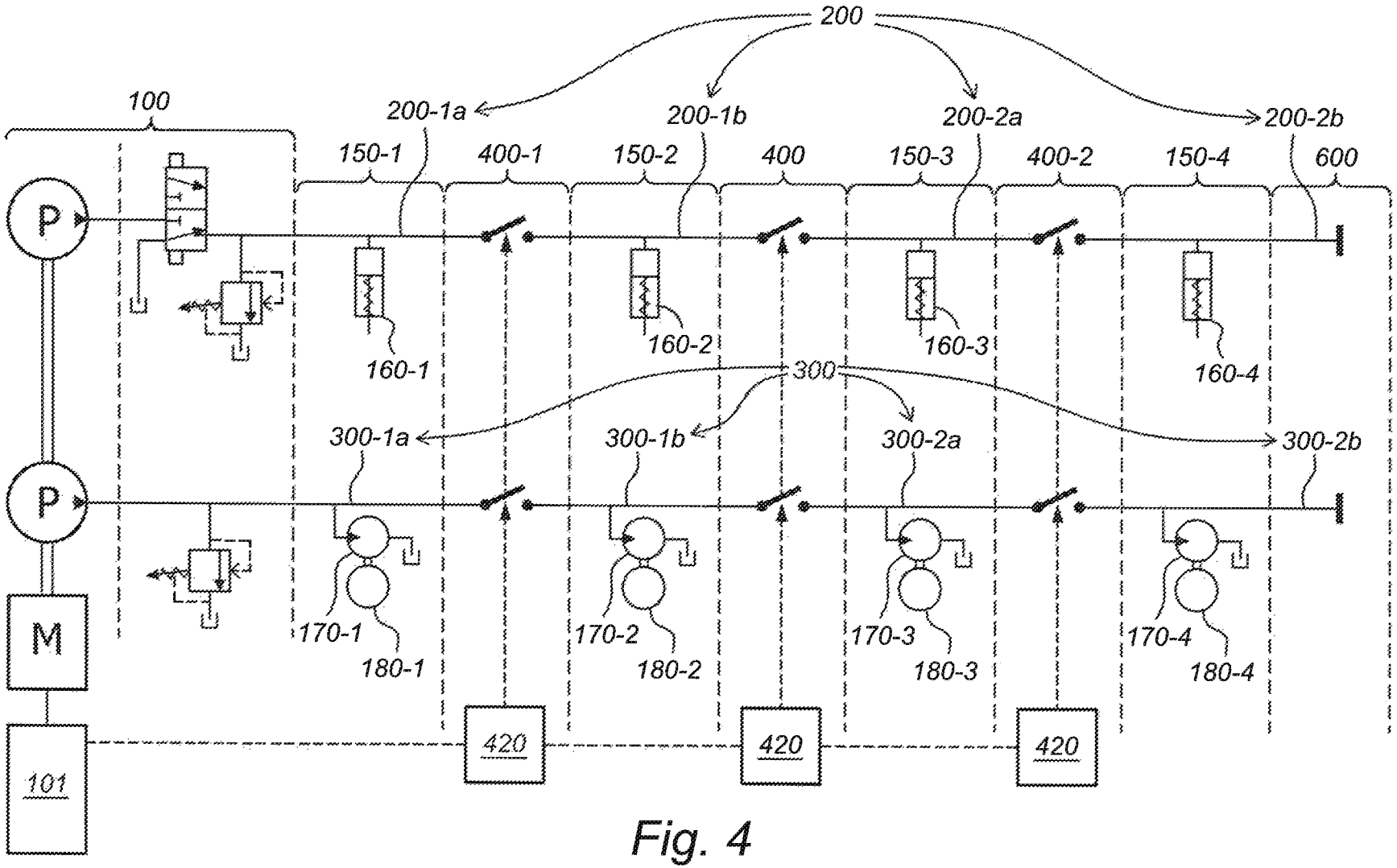

In the following is described an example of a preferred embodiment illustrated in the accompanying drawings, wherein:

FIG. 1 discloses a hydraulic system of a downhole tractor as known from the prior art;

FIG. 2 discloses a hydraulic system of a first embodiment of the downhole tractor in accordance with the invention;

FIG. 3 discloses a hydraulic system of a second embodiment of the downhole tractor in accordance with the invention, and FIG. 4 discloses a hydraulic system of a third embodiment of the downhole tractor in accordance with the invention.

DETAILED DESCRIPTION OF THE EMBODIMENTS

The current invention can be used to improve some or all of the above operational challenges as described in the introduction. The invention applies to downhole tractors, which employ one or more hydraulic circuits with functions like actuating the drive mechanism (tractor arm) so that it engages with the well bore, and/or driving the drive mechanism (tractor wheel) itself. In this figure description a lot of implementation details have been omitted, such details being known to the person skilled in the art of downhole tractors and hydraulic systems for downhole tractors. More implementation details can also be found in EP2,505,772 A1 for example.

FIG. 1 discloses a hydraulic system of a downhole tractor as known from the prior art. A typical downhole tractor with hydraulic drive consists of the following elements, which are normally connected together in the following order: a control section 101 with controls switching on and off the tractor function (either electronically or by mechanical means), a downhole motor M (electrically powered or fluid driven turbine), a hydraulic pump P with one or more outlets, a manifold block (or valve block) 110 which controls the hydraulic functions such as maximum pump pressure and the sequential deployment of the pump outputs. These elements constitute a hydraulic 'power pack' 100 whose output consists of one or more controlled hydraulic supply lines 200, 300 and a hydraulic fluid return line (not clearly shown) going back to a hydraulic tank 99.

FIG. 1 has been very schematically illustrated to facilitate reading of the drawing. In the embodiment of FIG. 1, there is two different hydraulic supply lines, namely a bidirectional hydraulic supply line 200 and a unidirectional supply line 300. In order to control the bidirectional hydraulic supply line 200, the manifold block 110 comprises at least a sequence valve 112 and a relief valve 114 as illustrated in FIG. 1 in addition to some other components. All this is considered well known to the person skilled in the art. In order to control the unidirectional hydraulic supply line 300, the manifold block 110 comprises a relief valve as illustrated in FIG. 1 in addition to some other components.

Normally, as illustrated in FIG. 1, the tractor drive sections are modules 150-1, 150-2, 150-3, 150-4, which can be added in parallel to the hydraulic supply lines provided by the power pack, so that sections can be added or removed as required. A typical example of such a construction would be as shown, with the electric motor M driving the pump P, and the pump P having two controlled output lines 200, 300, namely a first one for actuating (spring-loaded) hydraulic cylinders 160 actuating tractor drive arms (not shown) against the wellbore and a second one for powering hydraulic motors 170, plus a fluid return line (not shown) to the hydraulic tank 99. Each hydraulic motor 170 drives a tractor wheel 180. A number of drive sections can be connected in parallel to the hydraulic supply lines 200, 300 as shown in FIG. 1.

Due to the modular nature of the construction of the downhole tractor, drive sections can be added to provide more pulling force as needed, but although this does give more driving force for the same pump output pressure, it also means that more motors are consuming the available pump flow so that the available flow per motor reduces and thereby the conveyance speed of the tractor reduces. With this type of construction of the current art, the tractor is built up from a certain number of modules based on the predicted job maximum requirements, but there is very little or no control of the configuration once the tractor is deployed in the well. At the end of the hydraulic supply lines 200, 300 there is provided a termination module 600 for ensure proper termination of said hydraulic supply lines 200, 300.

The invention addresses this issue by adding new functionality to the hydraulic circuit. In the examples hereinafter this functionality has been integrated into a new module, one or more of which can be selectively placed above, between or below the drive sections due to the modular construction.

As will be explained with reference to the following figures, the invention (i.e. a module) connects to the hydraulic supply lines 200, 300 and adds the ability selectively control the line pressure, and/or to switch on and off the continuity of the hydraulic lines. This is done by means of electrically controlled hydraulic valves. Several types of module are envisaged, depending on the exact challenges faced by the tractor for a particular operation. Only a few example of particular solutions are described hereinafter.

FIG. 2 discloses a hydraulic system of a first embodiment of the downhole tractor in accordance with the invention. This figure will be mainly discussed in as far as it differs from FIG. 1. In the event that a downhole tractor of the type described is to be used in an oil well with a very long tractor conveyance interval while a lot of pulling force is required, a tractor with four driving sections may be required to perform the task at the maximum well depth. However, with four driving sections the tractor will proceed at a less than optimal speed during the first 50% of the tractor interval, as described previously. Whereas without the current invention there is very little that can be done with this configuration, the invention makes it possible to add a hydraulic switch module 400 between the second and third drive sections as illustrated in FIG. 2. It must be stressed that it is not essential to integrate this functionality as a separate module in a downhole tractor, yet this embodiment is considered advantageous for practical reasons.

The hydraulic switch module 400 comprises a first controllable valve 410-1 placed in the first hydraulic supply line 200 and a second controllable valve 410-2 placed in the second hydraulic supply line 300, wherein said controllable valves 410-1, 410-2 are controlled by a control unit 420 as illustrated. The controllable valves 410-1, 410-2 may be latching, meaning that they hold their state even when no voltage or current applied (advantageous for low-power consumption of the tractor). Alternatively, the valves may be non-latching in that they need a voltage or current to be applied in order to hold their state (advantageous for better control of the tractor). Each controllable valve 410-1, 410-2 effectively divides the respective hydraulic supply line 200, 300 into two parts 200-1, 200-2, 300-1, 300-2 as illustrated. Closing the respective valves 410-1, 410-2 (meaning opening the symbolic switches) will disconnect the respective second parts 200-2, 300-2 from the first parts 200-1, 300-1. In this way, the hydraulic switch module 400 can be used to disconnect the hydraulic supply to the two drive sections 150-3, 150-4 connected after the module as illustrated. This allows the tractor to be driven using only two of the driving sections 150-1, 150-2 for the first lighter duty part of the operation, allowing the individual tractor motors to receive more flow each and thus increasing the conveyance speed. When a depth into the well is reached where more tractor force is required, the selective module can be actuated (valve opened, switch closed) to connect the remaining drive sections 150-3, 150-4 to the supply lines 200, 300, thus increasing available tractor force and proportionally reducing tractor conveyance speed. In this manner, the total operational efficiency of the tractor can be improved by using the invention. It goes almost without saying that any other number of tractor drive modules 150-1 . . . 150-4 can be used, as well as any other division by place the hydraulic switch module 400 at a different location in the chain. In addition, the downhole tractor may have more non-driven wheels.

It must be stressed at this moment that even if the valves 410-1, 410-2 (switches) have been placed in the main hydraulic supply lines 200, 300, this is not essential. The valves 410-1, 410-2 (switches) may also be placed in side or sub hydraulic supply lines (not shown in the drawings), in addition to or instead of the main hydraulic supply lines 200, 300. In the latter case the main hydraulic lines 200, 300 are not interrupted by the valves 410-1, 410-2.

FIG. 3 discloses a hydraulic system of a second embodiment of the downhole tractor in accordance with the invention. This embodiment will be mainly discussed in as far as it differs from FIG. 2. In this embodiment, the hydraulic pressure on the unidirectional hydraulic line 300 is modified by adding a pressure relief module 500 at the end of the driving modules right after the earlier discussed hydraulic switch module 400, which in this embodiment has only a controllable valve 410-2 in the second hydraulic supply line 300. The pressure relief module 500 comprises a relief valve 520, which is effectively controlled by the controllable valve 410-2. The relief valve in this example is a standard relief valve 520 coupled to the controllable valve 410-2, which is controlled by a control unit 420, similar to the earlier discussed controllable valves. In this embodiment the switch function (or controllable valve function) as described above has been combined with a pressure relief valve 520 to modify the pressure of the unidirectional hydraulic supply line 300 (typically used for driving the hydraulic motors driving the wheels). The pressure relief valve 520 draws the hydraulic pressure down to a lower value, if necessary to zero pressure, when fully set open coupling the hydraulic supply line 300 directly to the flow return line (not shown) and eventually the hydraulic tank 99. This embodiment could be for example a tractor used to convey milling equipment underneath. By using the combination of pressure relief module 500 the axial force applied to the milling bit (which is proportional to the wheel driveline pressure on the second hydraulic supply line 300) can be varied and tuned to give better milling performance.

An additional benefit of the embodiment of FIG. 3 is that a lower drive pressure on the second hydraulic line 300 also reduces the respective load on the pump P and the electrical drive motor M. This means that the electric power consumption of the tractor is proportionally reduced. In the case of an electrically powered tractor conveying an electrically powered milling motor on an electric wireline cable, where the maximum current is limited by the cable capacity, a reduction of the power consumption allows more available current for the milling motor which can further greatly increase the effectiveness of the operation.

In a variant of this embodiment of the invention, the controllable valve 410-2 may be placed outside the main hydraulic supply line 300 in the side branch leading to the pressure relief valve 520 for example. All such variants fall within the scope of the protection as claimed.

FIG. 4 discloses a hydraulic system of a third embodiment of the downhole tractor in accordance with the invention. This embodiment will be mainly discussed in as far as it differs from FIGS. 2, and 3. With reference to FIG. 2, this embodiment illustrates the option of repeating the invention by inserting two further hydraulic switch modules 400-1, 400-2 such that there is an option to have more than two operational modes. The further switch modules 400 effectively break the respective parts 200-1, 200-2, 300-1, 300-2 of the hydraulic supply lines 200, 300 into subparts 200-1*a* . . . 200-2*b*, 300-1*a* . . . 300-2*b*. In this embodiment it is now possible to have between one and four active driving modules by respective opening or closing of the controllable valves in the hydraulic switch modules 400.

In this figure description, it has been illustrated that by the use of controllable valves in the hydraulic supply lines, and the use of relief valves, many more possibilities for fine-tuning the tractor are opened up in particular for demanding downhole operations. In view of FIG. 4, for instance, it is also possible to add multiple relief modules to the downhole tractor.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. Downhole tractor comprising at least one hydraulic supply line for actuating hydraulic components, the downhole tractor comprising a plurality of tractor arms and a plurality of tractor wheels, the downhole tractor further comprising:

the at least one hydraulic supply line having a first supply section and a second supply section;

a hydraulic power pack including a motor, at least one hydraulic pump, and a manifold block, the power pack being coupled to the at least one hydraulic supply line;

at least one first drive section coupled to the first supply section of the hydraulic supply line having at least one hydraulic component and at least one second drive section coupled to the second supply section of the hydraulic supply line having one further hydraulic component, wherein said hydraulic components are coupled to the at least one hydraulic supply line in parallel and configured for being actuated by the at least one hydraulic supply line;

a hydraulic switch module being located between the at least one first drive section and the at least one second drive section, the hydraulic switch module including a valve control unit and a controllable valve located in the hydraulic supply line between the first and second supply sections of the at least one hydraulic supply line, and the controllable valve being selectively activated to couple the at least one second drive section to the at least one first drive section of the hydraulic supply line or to decouple the at least one second drive section from the at least one first drive section of the hydraulic supply line for allowing the downhole tractor to have a first operational mode wherein only the first section is driven and a second operational mode wherein both the first section and the second section is driven.

2. The downhole tractor in accordance with claim 1, wherein the at least one hydraulic supply line comprises a unidirectional hydraulic supply line.

3. The downhole tractor in accordance with claim 1, wherein the at least one hydraulic component comprises a plurality of hydraulic motors each configured for driving a respective tractor wheel.

4. The downhole tractor in accordance with claim 3, wherein the at least one further hydraulic component comprises a further plurality of hydraulic motors each configured for driving a respective tractor wheel.

5. The downhole tractor in accordance with claim 1, wherein the at least one hydraulic supply line comprises a bidirectional hydraulic supply line.

6. The downhole tractor in accordance with claim 5, wherein the at least one hydraulic component comprises a plurality of hydraulic cylinders each configured for driving a respective tractor arm.

7. The downhole tractor in accordance with claim 6, wherein the at least one further hydraulic component comprises a further plurality of hydraulic cylinders each configured for driving a respective tractor arm.

8. The downhole tractor in accordance with claim 1, wherein the at least one hydraulic component and/or the at least one further hydraulic component comprises a relief valve for modifying a hydraulic pressure on the at least one hydraulic supply line.

* * * * *